United States Patent [19]

Frederick

[11] 4,423,771

[45] Jan. 3, 1984

[54] HEAT EXCHANGER

[76] Inventor: Charles V. Frederick, Rte. #5, New Virginia, Iowa 50210

[21] Appl. No.: 228,252

[22] Filed: Jan. 26, 1981

Related U.S. Application Data

[63] Continuation of Ser. No. 934,867, Aug. 18, 1978, abandoned.

[51] Int. Cl.[3] ..... F28D 1/04; F28F 1/32

[52] U.S. Cl. ..... 165/151; 165/182; 29/157.3 A

[58] Field of Search ..... 165/151, 181, 182; 29/157.3 A, 157.3 B, 157.3 C

[56] References Cited

U.S. PATENT DOCUMENTS

| | | | |
|---|---|---|---|
| 1,761,395 | 6/1930 | Karmazin | 165/151 |
| 1,943,557 | 1/1934 | Ruthenburg et al. | 165/181 |
| 2,171,253 | 8/1939 | Day | 165/151 |
| 2,255,969 | 9/1941 | Ferreira | 165/181 |

FOREIGN PATENT DOCUMENTS

| | | | |
|---|---|---|---|
| 201934 | 11/1924 | United Kingdom | 165/151 |

*Primary Examiner*—William R. Cline
*Assistant Examiner*—Theophil W. Streule, Jr.
*Attorney, Agent, or Firm*—Zarley, McKee, Thomte, Voorhees & Sease

[57] ABSTRACT

A heat exchanger is disclosed comprising a plurality of spaced apart parallel plates having a plurality of apertures therein, a plurality of hollow frusto-conically shaped cone members having a larger base end and a smaller opposite end with the cone members being inserted in the apertures of the plate and being of such relative size to be tightly embraced by the peripheries of the apertures, the opposite ends of the cones in each of the plates being tightly nested and stacked in the base ends of the cones in the next adjacent plate, and means for fixedly securing the plates in parallel relation to bind the cone members in stacked relation.

3 Claims, 4 Drawing Figures

HEAT EXCHANGER

This is a continuation of application Ser. No. 934,867, filed Aug. 18, 1978, now abandoned.

BACKGROUND OF THE INVENTION

This invention relates to a heat exchanger and more particularly to a heat exchanger that is economically and simply assembled without the necessity of welding or the like. Prior heat exchangers required expensive welding or bonding techniques to construct and assemble the device. Also, once assembled by such welding or bonding techniques, the device could not easily be disassembled.

SUMMARY OF THE INVENTION

A heat exchanger is disclosed comprising a plurality of spaced apart parallel plates having a plurality of apertures therein, a plurality of hollow frusto-conically shaped cone members having a larger base end and a smaller opposite end with the cone members being inserted in the apertures of the plates and being of such relative size to be tightly embraced by the peripheries of the apertures, the opposite ends of the cones in each of the plates being tightly nested and stacked in the base ends of the cones in the next adjacent plate, and means for fixedly securing the plates in parallel relation to bind the cone members in stacked relation. The cone members frictionally, retentively engage the peripheries of the apertures and frictionally, retentively engage the base ends of the cones in the next adjacent plate to cooperate with the means for fixedly securing the plates in parallel relationship to form a sturdy, rigid structure.

It is a principal object of this invention to provide an improved heat exchanger.

A still further object of the invention is to provide a heat exchanger that can be constructed and assembled without welding or metal bonding.

A still further object of the invention is to provide a heat exchanger wherein the cone shaped members interlock to form a plurality of stacks for the removal of combustion byproducts.

A still further object of the invention is to provide a heat exchanger that is economical to construct and assemble, durable in use, and refined in appearance.

DESCRIPTION OF THE PREFERRED EMBODIMENT

Figure 1:
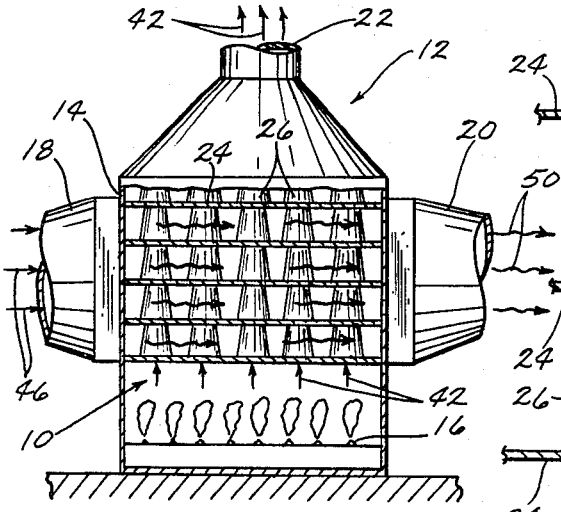
FIG. 1 is a partially broken away plan view of this invention.

The numeral 10 generally refers to the heat exchanger device of this invention shown in FIG. 1 mounted within furnace 12.

Furnace 12 is comprised of housing 14, combustion heat source 16, clean air intake duct 18, heated air discharge duct 20, chimney discharge stack 22 and heat exchanger 10.

Figure 2:
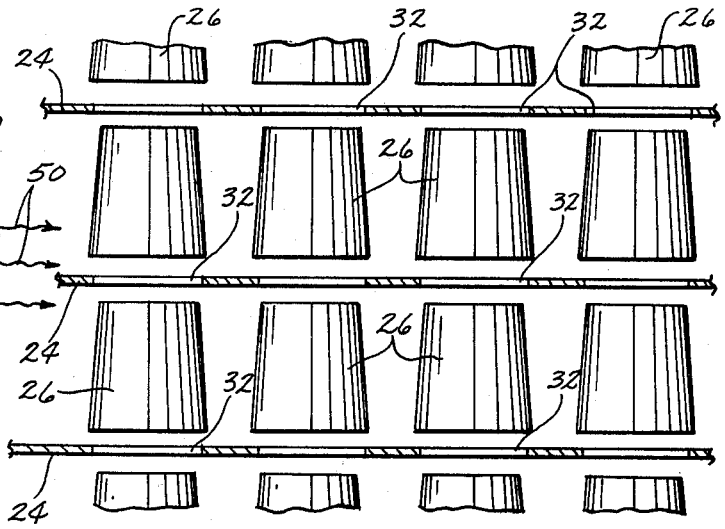
FIG. 2 is an enlarged exploded view of a portion of the invention.
Figure 3:
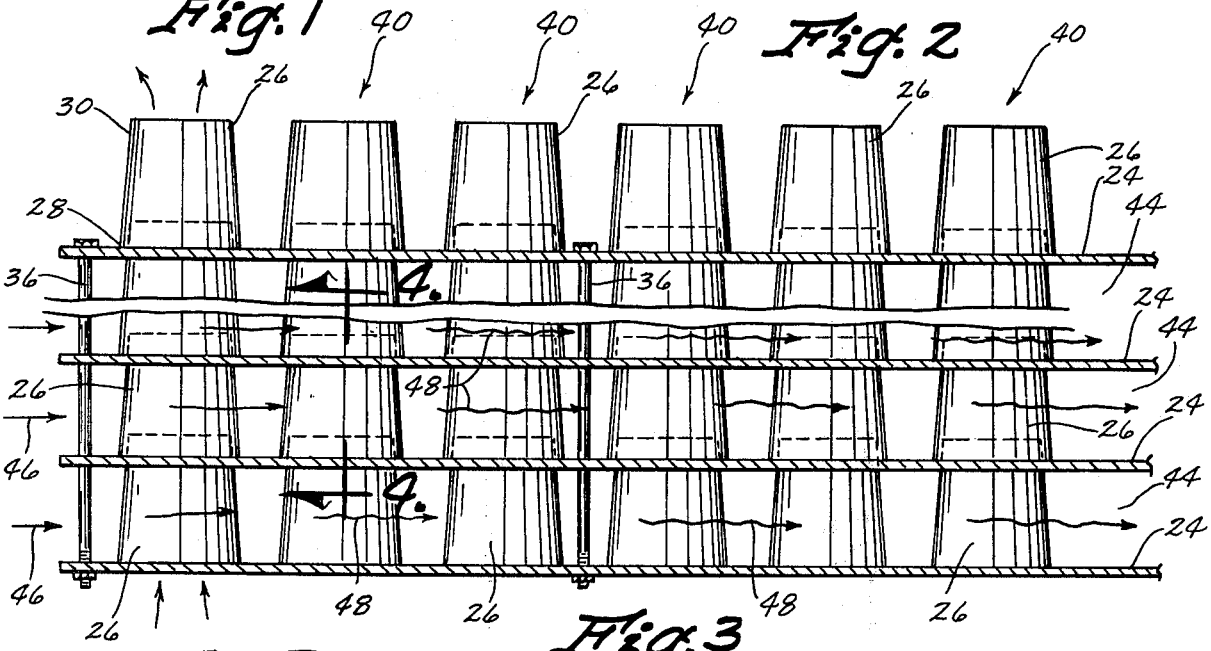
FIG. 3 is an assembled view similar to FIG. 2.
Figure 4:
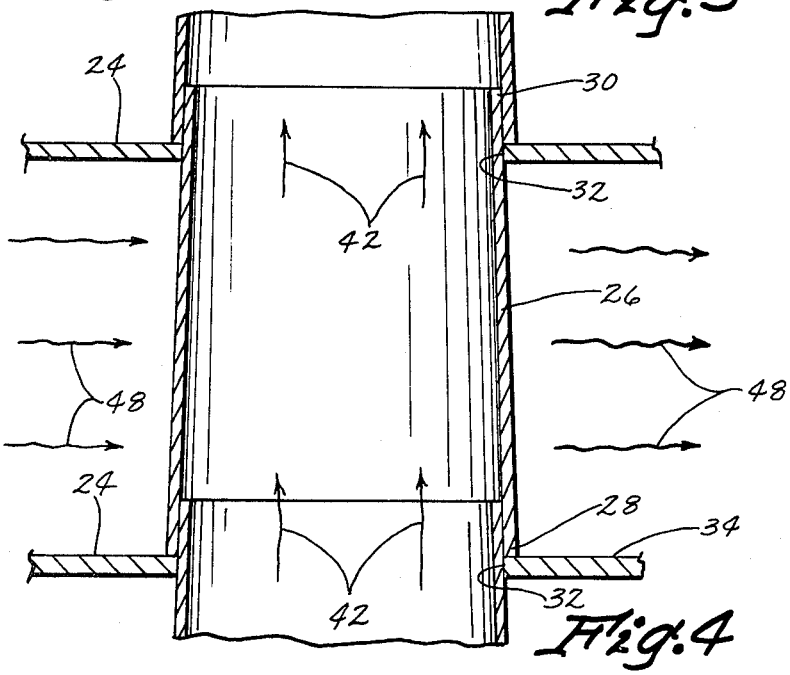
FIG. 4 is an enlarged sectional view seen on line 4—4 of FIG. 3.

Heat exchanger 10 is comprised of a plurality of spaced apart parallel plates 24 interconnected with a plurality of hollow frusto-conically shaped cone members 26. Each cone member 26 has a larger base end 28 and a smaller opposite end 30. Plates 24 have a plurality of apertures 32 (FIG. 2) to receive the opposite end portion 30 of cone 26 as shown in FIG. 4. The apertures 32 of the plates 24 are aligned such that the cone members 26 may be stacked as shown in FIG. 3. In this configuration, cone 26 is received within aperture 32 so as to be tightly embraced by the peripheries of aperture 32 and opposite end 30 of cone 26 is tightly nested within the larger base end 28 of the above adjacent cone member as shown in FIG. 4. The relative sizes of opposite end 30, aperture 32, and base end 28 produces a frictional retentive engagement of opposite end 30 with both base end 28 and aperture 32. As seen in FIG. 4, base end 28 abuts the top surface 34 of the adjacent plate 24.

To fixedly secure the plates 24 in a parallel relationship to bind the cone members 26 in the stacked relationship shown in FIG. 3, bolt 36 passes through apertures (not shown) in plates 24 and threadably engages nut 38. Thus, the cone members are held within the apertures 32 of the plates 24 and within the base ends 28 of adjacent cone members so as to form a plurality of stacks 40 by mechanical means without the use of expensive welding or metal bonding techniques.

As can be seen, the construction and assembly of heat exchanger 10 is simple and economical, yet sturdy for the purpose intended.

In operation, the heat exchanger 10 is securely positioned within housing 14 of furnace 12. As seen in FIG. 1, the combustion heat source 16 is directly below the lower end of stacks 40 with chimney discharge stack 22 directly above stacks 40. The products of combustion rise up through stacks 40 to be discharged out stack 22 as indicated by flow arrows 42 (FIG. 1). The spaced apart parallel disposition of plates 24 form a plurality of horizontally parallel air ways 44 around the cone members 26. Clean air is passed into intake duct 18, through air ways 44, thereby picking up heat and exiting through discharge duct 20 to be used for heating purposes. As shown in FIGS. 1 and 3, flow arrows 46 depict the entering fresh air, flow arrows 48 depict the air flowing through air ways 44 and being heated and flow arrows 50 depicting the exiting heated clean air.

Should disassembly be desired, the heat exchanger 10 is disassembled by disengaging bolt 36 and nut 38 and subsequently disengaging the frictionally engaged cone elements and plates 24.

Thus, it can be seen that this device accomplishes at least all of its stated objectives.

What is claimed is:

1. A heat exchanger comprising a plurality of spaced apart parallel flat plates having a plurality of apertures therein, with each aperture dwelling entirely within the thickness of said plates, a plurality of hollow frusto-conically shaped cone members having a larger base end and a smaller opposite end, said cone members having straight tapered side walls that uniformly decrease in diameter from said base end to said opposite end, said cone members being inserted in the apertures of said plates and being of such relative size to be tightly embraced by the peripheries of said apertures whereby said cone members only frictionally retentively engage said peripheries of said apertures, the opposite ends of said cones in each of said plates being tightly nested and stacked in the base ends of the cones in the next adjacent plate whereby said opposite ends of said cones only frictionally retentively engage said base ends of said cones in the next adjacent plate, and means for fixedly securing said plates in parallel relation to bind said cone members in stacked relation with said cones in each of said plates tightly engaging the apertures of said plate and being tightly nested in the base end of the cones in the next adjacent plate, said means for fixedly securing said plates comprising mechanical securement means interconnecting said plates remote from said cones, said stacked cone members forming a plurality of stacks generally perpendicular to said spaced apart plates, and said spaced apart plates forming a plurality of air passageways between said plates with said stacks within said passageways.

2. The heat exchanger of claim 1 wherein the base ends of the cones in one plate abutt and engage the surface of the next adjacent plate whereby the base ends of said cones in said one plate extend around the periphery of an aperture in the next adjacent plate.

3. A heat exchanger comprising a plurality of spaced apart parallel flat plates having a plurality of apertures therein, a plurality of hollow frusto-conically shaped cone members having a larger base end and a smaller opposite end, said cone members being inserted in the apertures of said plates and being of such relative size to be tightly embraced by the peripheries of said apertures whereby said cone members frictionally retentively engage said peripheries of said apertures, the opposite ends of said cones in each of said plates being tightly nested and stacked in the base ends of the cones in the next adjacent plate whereby said opposite ends of said cones frictionally retentively engage said base ends of said cones in the next adjacent plate, and means for fixedly securing said plates in parallel relation to bind said cone members in stacked relation said means for fixedly securing said plates comprising mechanical securement means, the base ends of the cones in each of said plates abutting and engaging the surface of the next adjacent plate whereby the base ends of said cones extend around the periphery of an aperture in the next adjacent plate, said stacked cone members forming a plurality of stacks generally perpendicular to said spaced apart plates, and said spaced apart plates forming a plurality of air passageways between said plates with said stacks within said passageways.

* * * * *